US007300228B2

(12) United States Patent
Colbert

(10) Patent No.: US 7,300,228 B2
(45) Date of Patent: Nov. 27, 2007

(54) METHOD AND APPARATUS FOR PREVENTING DOCK OR STRUCTURE PILING UPLIFT

(76) Inventor: Robert Colbert, 254 E. Shore Rd., Lindenhurst, NY (US) 11757

( * ) Notice: Subject to any disclaimer, the term of this patent is extended or adjusted under 35 U.S.C. 154(b) by 151 days.

(21) Appl. No.: 10/988,855

(22) Filed: Nov. 15, 2004

(65) Prior Publication Data

US 2005/0249557 A1 Nov. 10, 2005

Related U.S. Application Data

(63) Continuation-in-part of application No. 10/842,590, filed on May 10, 2004.

(51) Int. Cl.
*E02D 5/60* (2006.01)

(52) U.S. Cl. ..... 405/216; 405/217

(58) Field of Classification Search ..... 405/211–212, 405/216, 217; 392/304
See application file for complete search history.

(56) References Cited

U.S. PATENT DOCUMENTS 2,484,063 A * 10/1949 Ackley ..... 392/304
4,252,471 A * 2/1981 Straub ..... 405/211
5,436,429 A * 7/1995 Cline ..... 219/202

* cited by examiner

*Primary Examiner*—Tara L. Mayo
(74) *Attorney, Agent, or Firm*—Keusey, Tutunjian & Bitetto, P.C.

(57) ABSTRACT

A piling anti-lift system utilizes a heat trace cable secured around a piling and extending above and below the water level of the surrounding water. An annular space is formed between the piling anti-lift system. The heated piling anti-lift system prevents the water in the annular space from freezing and thereby prevents the piling from being subject to uplifting or heaving that results from the rising tide of surrounding frozen waters. In the event of extreme water temperatures and the freezing of the water in the formed annular space, the piling anti-lift system keeps the piling independent of the frozen surrounding water. In this situation, the piling anti-lift system will break free from the frozen water in the annular area and rise with the rising tide waters, thus continuing to keep the piling independent from the rising frozen tide waters.

10 Claims, 9 Drawing Sheets

METHOD AND APPARATUS FOR PREVENTING DOCK OR STRUCTURE PILING UPLIFT

RELATED APPLICATION INFORMATION

This application is a Continuation-in-Part of co-pending U.S. patent application Ser. No. 10/842,590 filed May 10, 2004, the entire contents of which are incorporated herein by reference.

BACKGROUND OF THE INVENTION

1. Field of the Invention

The present invention relates to dock and structural pilings. More particularly, it relates to a method and apparatus for preventing piling uplift caused by frost heaving or shifting, or rising frozen tide waters.

2. Description of the Prior Art

U.S. Pat. No. 4,127,002 relates to a permanent pier piling for use in docks and the like in a body of water whereby an antifreeze solution within the piling circulates to distribute latent ground heat from the lower portion of the piling to the upper portion of the piling to maintain a fluid interface between the piling and the ice during the winter season.

U.S. Pat. No. 4,464,083 relating to an ice guard for protecting a vertically extending piling positioned in a body of water from damage due to changes in water and ice levels. The ice guard is concentrically positioned around a piling and extends above the surface of the body of water. The ice guard is held in place by the surrounding ice. The ice guard includes at least one longitudinally extending sleeve which is made of a buoyant material and a means for restricting vertical movement of at least a portion of the sleeve.

U.S. Pat. No. 4,818,148 relates to a covering applied on the outer surface of a pile including a steel pipe or the like to surround a predetermined length thereof so as to reduce frost heaving force or negative friction acting on the pile in a frigid area. The covering is closely adhered by an adhesion layer to the pile.

U.S. Pat. No. 4,585,681 relates to a frost damage proofed pile for installment in a frigid district where the pile is subjected to a freezing and frost heaving force, such as permanently or seasonally frozen soil terrain. A tubular sheath member is fitted over the pile surface and has a length longer than the thickness of an active or seasonally frozen soil layer of the terrain in which the pile is installed. At least a portion of the length of the pile is formed as an extensible section, and at least the lower end of the sheath member is secured to the pile at or below a position corresponding to the bottom region of the active or seasonally frozen soil layer. A fluid material is filled in a space defined between the pile and the sheath member.

U.S. Pat. No. 4,512,683 relates to a sleeve adapted to float in water to surround a piling to protect the same from being lifted by ice. It includes an outer corrugated casing which can be easily gripped by ice forming therearound. Within the casing is a layer of waterproof cementitious material followed by a layer of closed cell foam plastic. Should ice form in the annular space between the piling and the sleeve, the sleeve can easily slide up or down across the outer surface of the ice without moving the piling.

The prior art devices generally provide a mechanism that is capable of sliding up and down the piling or ice with the shifting tides or frost lines. However, with the increasingly colder winters in, the temperatures are so low below freezing that the water around the piling freezes. This freezing of the water adjacent the piling defeats the purpose of the prior art devices and causes the piling to lift, along with prior art piling anti-lift devices. Thus, a need exists for a new alternative to the prior art devices.

SUMMARY OF THE INVENTION

It is therefore an aspect of the present invention to overcome the shortfalls of the prior art and provide a method and apparatus that prevents piling uplift in extreme cold weather environments.

It is a further aspect of the invention to provide a method and apparatus for preventing piling uplift by preventing the water between the device and the piling from freezing.

It is yet another aspect of the invention to provide a method and apparatus for preventing piling uplift by maintaining the piling independent of the surrounding freezing environment.

This and other aspects are achieved in accordance with the invention wherein the piling anti-lift system includes a heat trace cable, a support device adapted to receive and secure the heat trace cable in a substantially concentric configuration around the piling and an electric connection for providing power to the heat trace cable. The support device is adapted to maintain an annular space between the support device and the piling.

In accordance with another aspect of the invention, the support device can be a flat sheet of material on which the heat trace cable is secured. A waterproof covering contains and seals the flat sheet of material, and thereby the heat trace cable, from surrounding water and/or dirt. The waterproof flat sheet is wrapped around the piling in the concentric configuration such that the annular space between the piling and the anti-lift system is maintained.

In accordance with another aspect of the invention, the support device includes a flat pipe having an elongate cavity and end seals for providing a water and air tight seal. The heat trace cable is disposed in elongate cavity and is connected to the electric connection through said flat pipe or said end seals. The air chamber in the flat pipe will help the flotation of the device around a piling.

According to yet another aspect of the invention, the support device can include at least two clips having a plurality of cable receiving portions for receiving and securing the heat trace cable in a repeating manner to provide a substantially enclosed device capable of enclosing a piling and maintaining an annular space therebetween.

According to another aspect of the invention, the support device can be formed of a tubular member for receiving the heat trace cable. The tubular member is then shrink wrapped such that the tubular member is completely enclosed with the heat trace cable in a water and air tight way.

According to a further aspect of the invention, the support device can be formed of a first tubular member for receiving the heat trace cable, and a second tubular member for receiving the first tubular member such that an air chamber is formed between the first and second tubular members. An end cap on each end encloses the open ends in a water and air tight manner and create an air chamber between the two tubular members. The air chamber facilitates the flotation of the device.

According to yet a further aspect of the invention, the support device can be formed from a first longitudinally split tubular member for receiving the heat trace cable, and a second longitudinally split tubular member for receiving the first tubular member. At least one latching device is coupled to the longitudinal split of both the first and second tubular members. The latching device enables the combined tubular members to be secured concentrically around a piling.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings wherein like reference numerals denote similar components throughout the views.

DETAILED DESCRIPTION OF PREFERRED EMBODIMENTS

Figure 1:
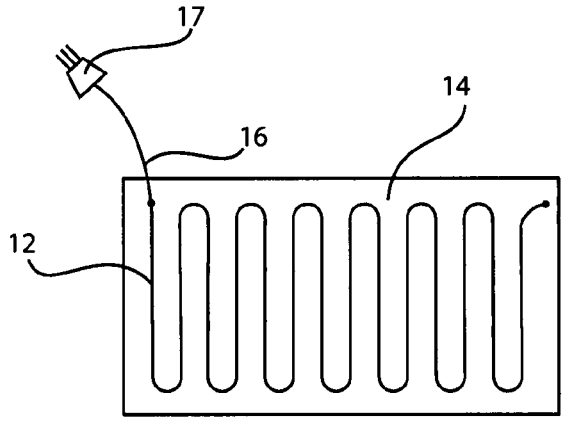
FIGS. 1-3 show the piling anti-lift system according to an embodiment of the invention.
Figure 2:
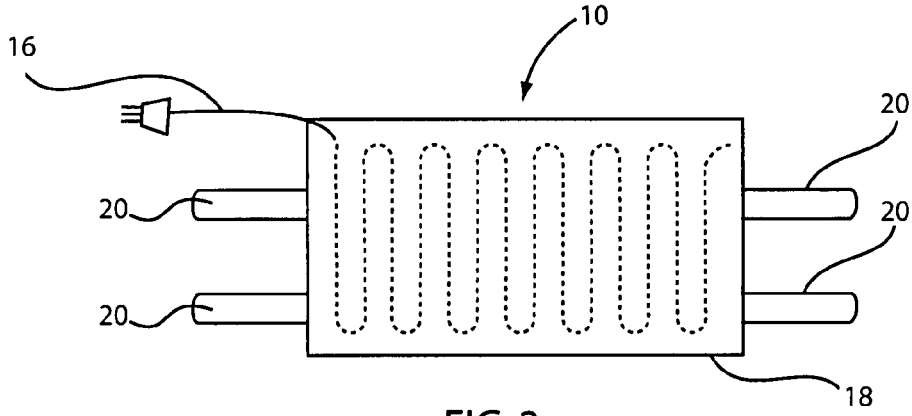
Figure 3:
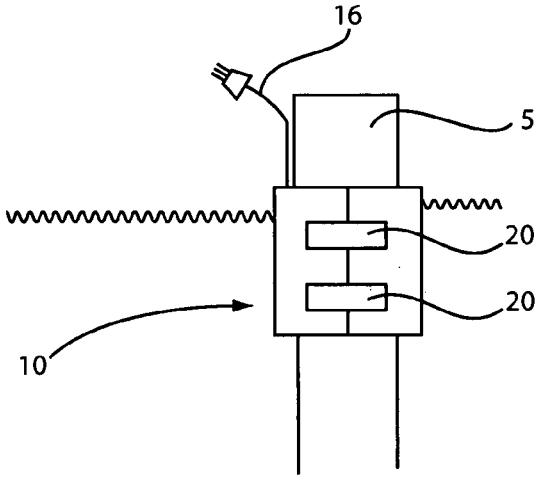

FIGS. 1-3 show the piling anti-lift system 10 according to an aspect of the invention. As shown, a heat trace cable 12 is connected to a flat sheet 14 in any suitable configuration. Flat sheet 14 is preferably a plastic or rubberized sheet capable of withstanding cold temperatures in the range of 20-40 degrees Fahrenheit. The electric connection 16 is connected to the heat trace cable 12 and includes a plug end 17 for connection to an outlet.

The flat sheet 14 with heat trace cable adhered thereto is then enclosed in a waterproof material 18 (e.g., fabric, plastic, etc.) and releasably connectable straps 20 are provided on each end of the enclosed sheet 14. The anti-piling list system 10 can then be wrapped around a piling 5 (FIG. 3) and function to prevent the same from being lifted due to freezing water or terrain.

Figure 4:
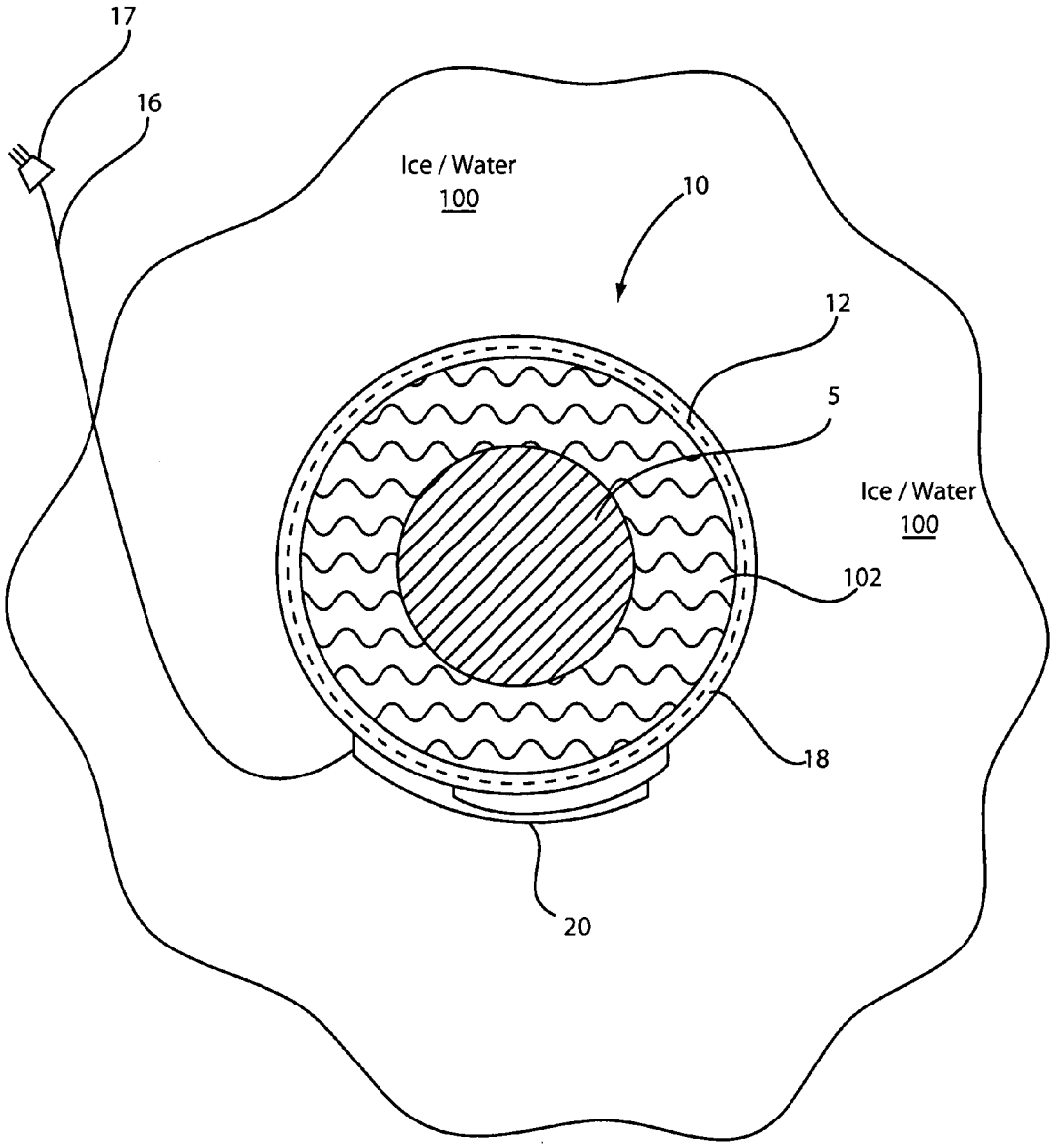
FIG. 4 is plan view of the piling anti-lift system according to the present invention.

FIG. 4 shows the concept of the present invention as applied with the piling anti-lift system 10. It is important to understand that this concept applies to all embodiments disclosed herein, and that the embodiment of FIGS. 1-3 are used for explanatory purposes only. As shown, the enclosure 18 is wrapped around a piling 5 and secured to itself using straps 20. In this manner, the water/ice 100 is shielded from the water/ice in the annular space 102 between the piling anti-lift device 10 and the piling 5.

When the water 100 freezes, the heating activity of the heat trace cable can often prevent the water in the annular space 102 from freezing. In this instance, the piling anti-lift device 10 will rise and fall with the water tides, while the piling remains free from any such movement in the frozen water. In the event of very cold weather, it is possible that the water in the annular space 102 can also freeze. In this event, the piling anti-lift device 10 operates to retain the piling independent from the exterior ice 100, which translates into the piling remaining independent from the massive strength of the vertical ice movement caused by the tides. In this mode of operation, the tide may rise and fall, the heated piling anti-lift device 10 will maintain the piling 5 independent from the ice 100 and prevent any upward lift that could be cause by a rising tide of frozen water.

Figure 5A:
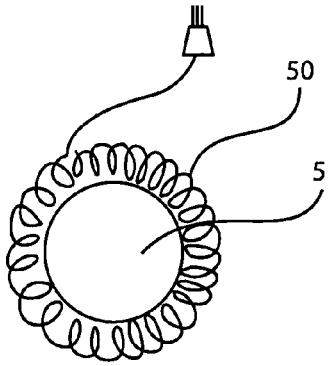
FIGS. 5*a*, 5*b* and 6 show the piling anti-lift system according to another embodiment of the invention.
Figure 5B:
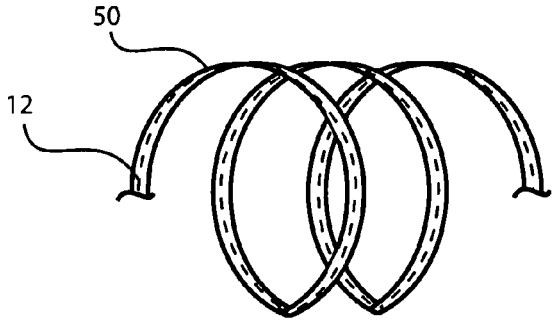
Figure 6:
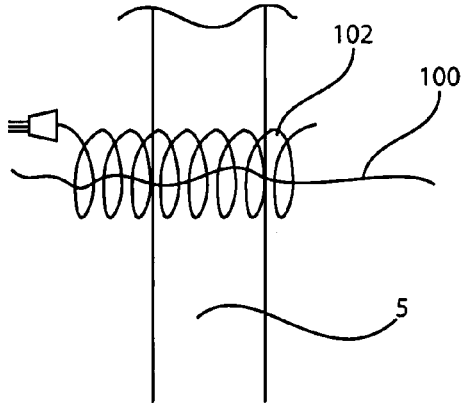

FIGS. 5*a*, 5*b* and 6 show another embodiment where the heat trace cable 12 is enclosed in a coiled watertight hose 50, with the electrical connection 16 extending therefrom. As shown, the coiled hose 50 is disposed around the piling 5 in a horizontal manner such that it sits in the water and extends above and below the surface of the water at least a few inches in each direction. The increase surface area of the coiled hose 50 allows a greater heat transfer from the heat trace cable to the water. In this manner, the water within the annular space 102 between the hose 50 and the piling 5 is prevented from freezing.

Figure 7:
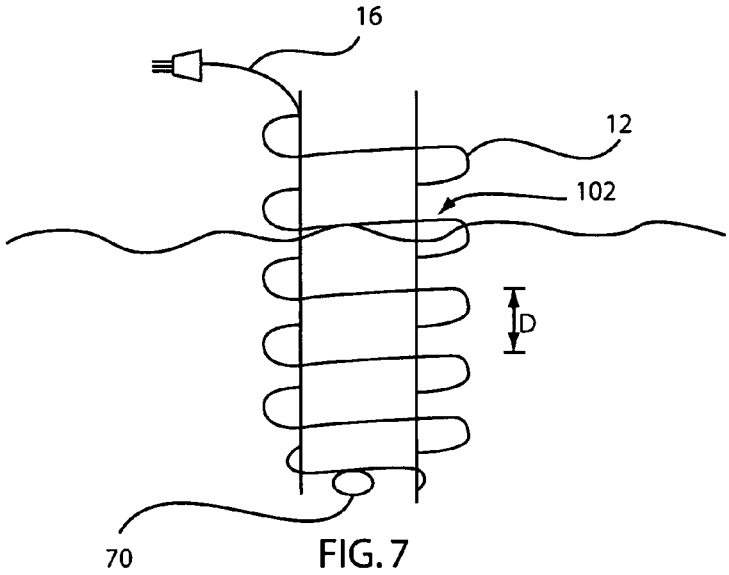
FIG. 7 shows the piling anti-lift system according to another embodiment of the invention.

FIG. 7 shows another embodiment where the coiled hose 50 is disposed around poling 5 in a vertical manner. A weight or other device 70 is provided to maintain the lower portion of the coiled hose 50 below the water surface. The distance D between coilings can be chosen according to application and is a matter of design choice. For example, the distance D can be in a range of 0.1-2.0 inches depending on depth and anticipated tide and temperature fluctuations. According to a variation of this embodiment, the heat trace cable 12 may be sealed in water/salt tight encasing and wrapped around the piling 5 as shown, thereby eliminating the need for a coiled hose.

Figure 8:
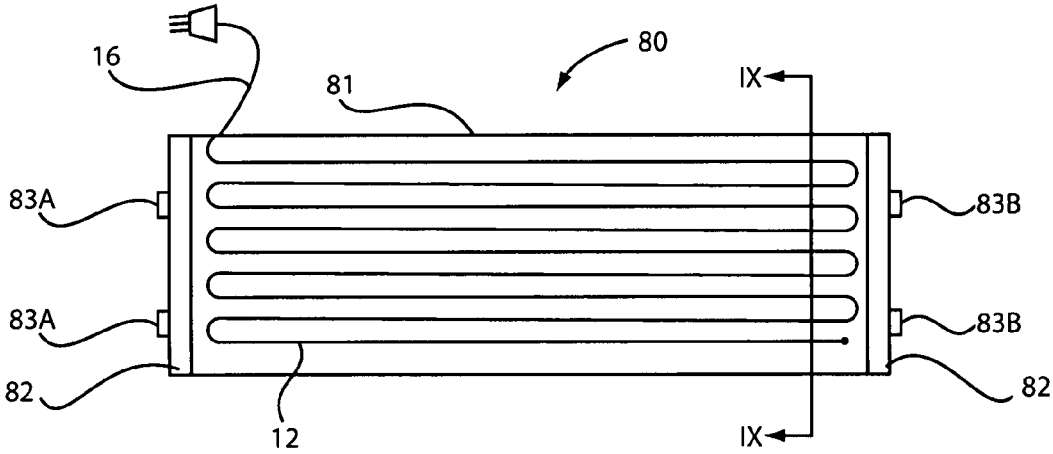
FIGS. 8-10 show the piling anti-lift system according to another embodiment of the invention.
Figure 9:
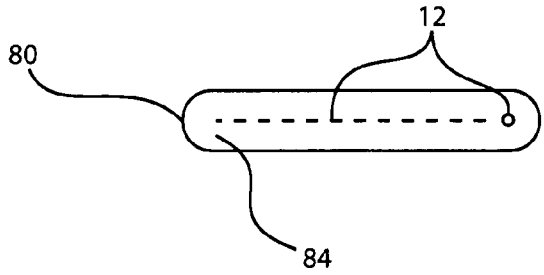
Figure 10:
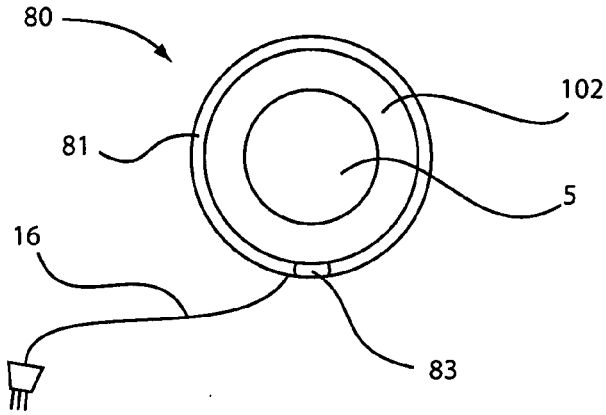

FIGS. 8-10 show the piling anti-lift system 80 according to another embodiment of the invention. A flat pipe 81 includes an elongated cavity 84 within which the heat trace cable 12 is disposed. At each end of the flat pipe 81 is an end cap/seal 82 that provides a water tight seal to the cavity 84. Each of the end caps/seals 82 include a latch or connector 83*a* that engages and secures to an oppositely positioned latch or connector 83*b* on the other side when wrapped around a piling 5 (see FIG. 10).

FIGS. 11*a*, 11*b*, 11*c*, 12*a* and 12*b* show another embodiment of the piling anti-lift system 105 according to the invention. Clip devices 110 are used to retain the heat trace cable 12 in a concentric configuration with respect to the piling. Clip devices 110 include retaining clips 112 or any other suitable type of receiving end for a tubular member (like the heat trace cable) and may be arranged in a horizontal or vertical arrangement. In the vertical embodiment (FIGS. 11*a* and 12*a*), clip devices 110*a*, 110*b* and 110*c* are shown and are capable of receiving and securing the heat trace cable 12. Two or more clip devices 110 can be used to achieve the desired positioning with an annular area 102 between the heat trace cable 12 and the piling 5.

Figure 11A:
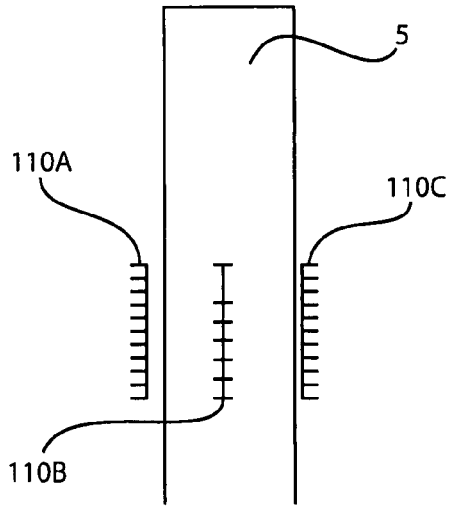
FIGS. 11*a*-11*c* and 12*a*-12*b* show the piling anti-lift system according to another embodiment of the invention.
Figure 11B:
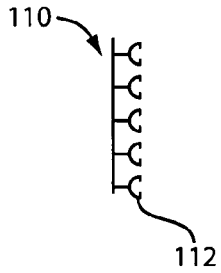
Figure 11C:
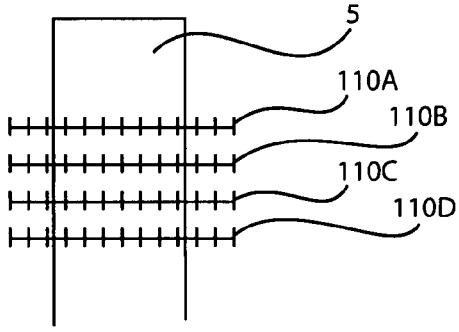
Figure 12A:
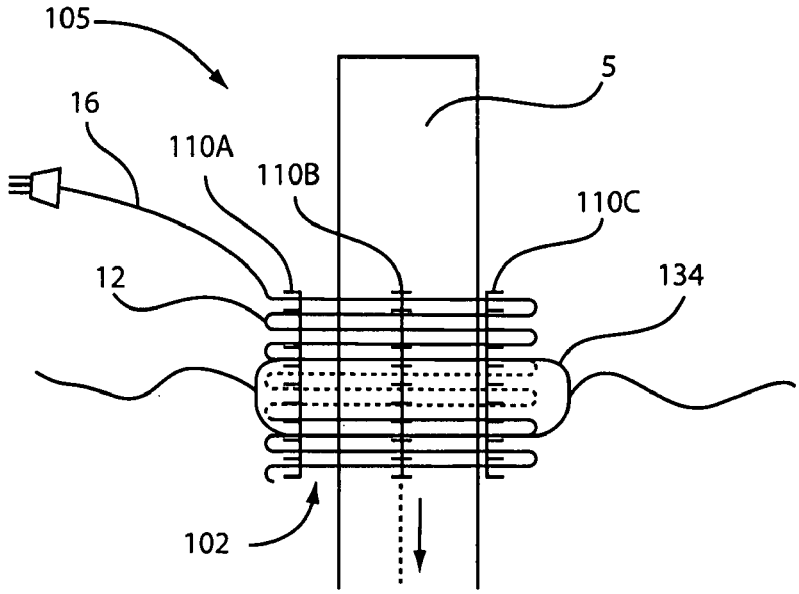
Figure 12B:
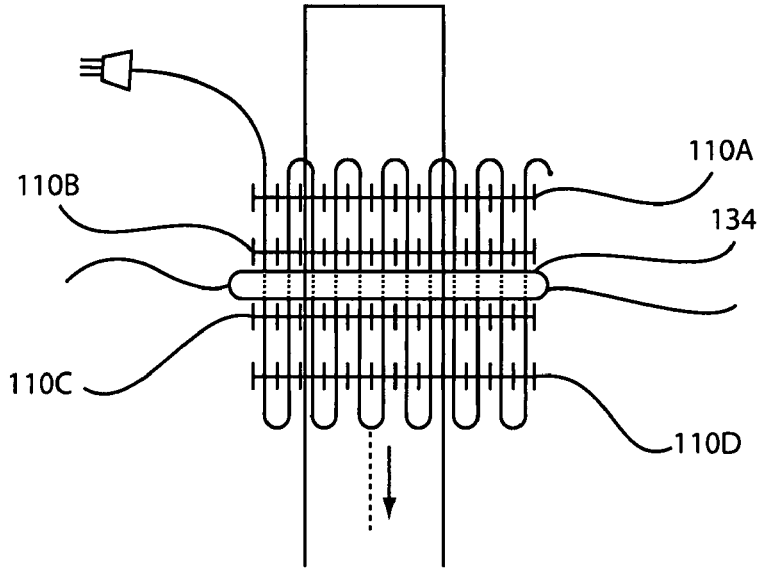

FIGS. 11*c* and 12*b* show the clips 110 arranged in a horizontal position. Clip devices are not connected to the piling and are simply retained in place by their retention of the heat trace cable 12. A flotation device 134 can be added to the clip arrangement 110 to maintain the piling anti-lift system 105 in its preferred position with a pre-determined amount of downward length (i.e., depending on desired application). The flotation device can be any suitable device that is not bulky and can be wrapped around the anti-lift system 105 and is attached thereto.

The length of the piling anti-lift system 105, or any embodiment disclosed herein, is a matter of design application and will depend entirely on the depth of tide water rising and falling, and/or the depth of anticipated ice build up. As explained above, by maintaining the separation between the annular area 102 and the outer water/ice 100, the piling anti-lift device 105 functions to isolate the annular space 102 and thereby piling 5 from the shifting water/ice 100.

Figure 13:
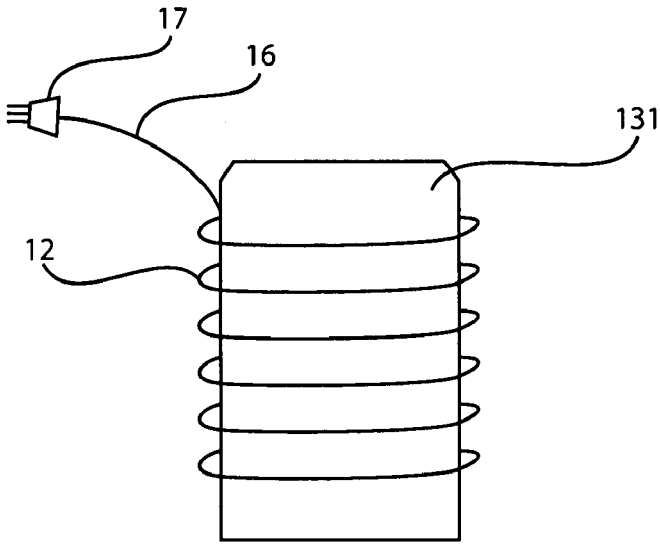
FIGS. 13-14 show the piling anti-lift system according to another embodiment of the invention.
Figure 14:
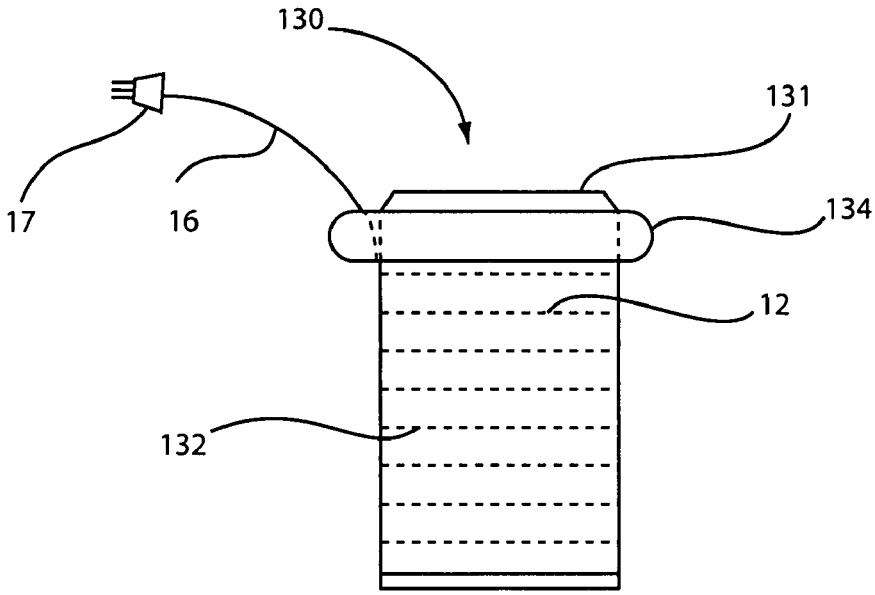

FIGS. 13 and 14 show another embodiment of the piling anti-lift system 130 according to the invention. The heat trace cable 12 is wrapped around a tubular member 131. Tubular member 131 is preferably larger in diameter than the piling 5 such that the annular space 102 is formed there between when the tubular member 131 is disposed around the piling. Once the heat trace cable is wrapped around tubular member 131, the entire tubular member is shrink wrapped with an outer water proof material 132, thereby sealing the heat trace cable from the water/salt surrounding environment. By way of example, the shrink wrapping can be made of plastic, rubber, waterproof fabrics or textiles, and any other material that can be suitably secured around the tubular member 131 with heat trace cable 12 wrapped therearound. A flotation device 134 can be added to the configuration of system 130 to assure proper placement in the water around the piling.

Figure 15:
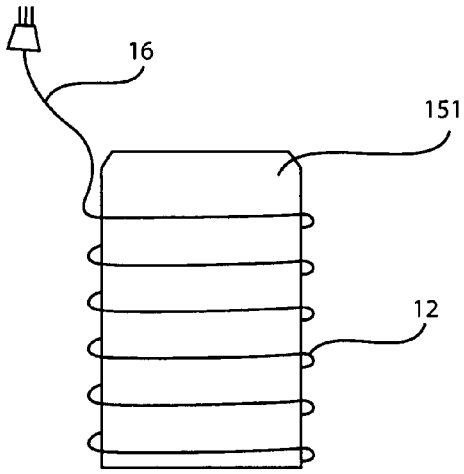
FIGS. 15-17 show the piling anti-lift system according to another embodiment of the invention.
Figure 16:
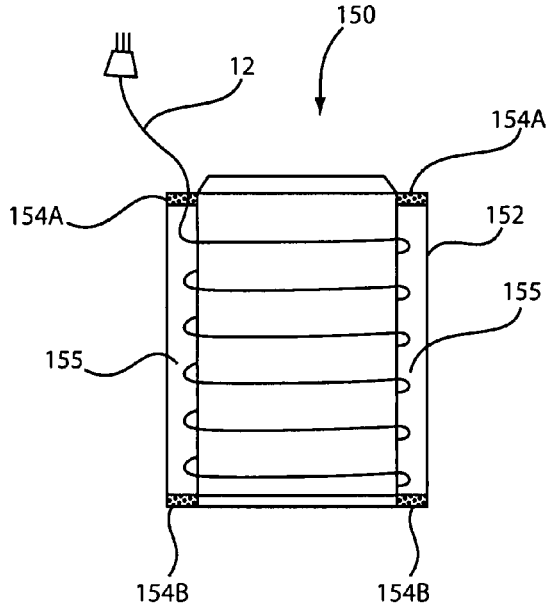
Figure 17:
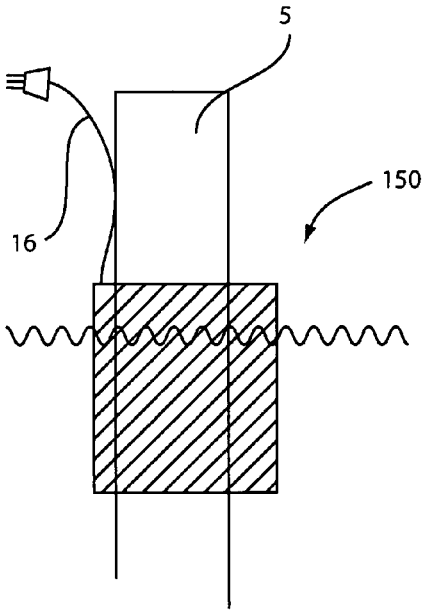

FIGS. 15-17 show the piling anti-lift system 150 according to another embodiment of the invention. The heat trace cable 12 is wrapped around a tubular member 151 as shown. The wrapped tubular member 151 is then inserted into a larger tubular member 152 and the top is secured with a water and airtight ring 154*a*, while the bottom is also sealed with a water and airtight ring 154*b*. An air space or chamber 155 is formed between the two tubular members 151 and 152 and aides in the flotation of the device around the piling. The heat from the heat trace cable fills this chamber 155 and prevents the water within the annular region 102 from freezing and/or contacting the frozen exterior water 100 (See FIG. 4), thus preventing uplift of the piling in response to rising tides of frozen water.

Figure 18:
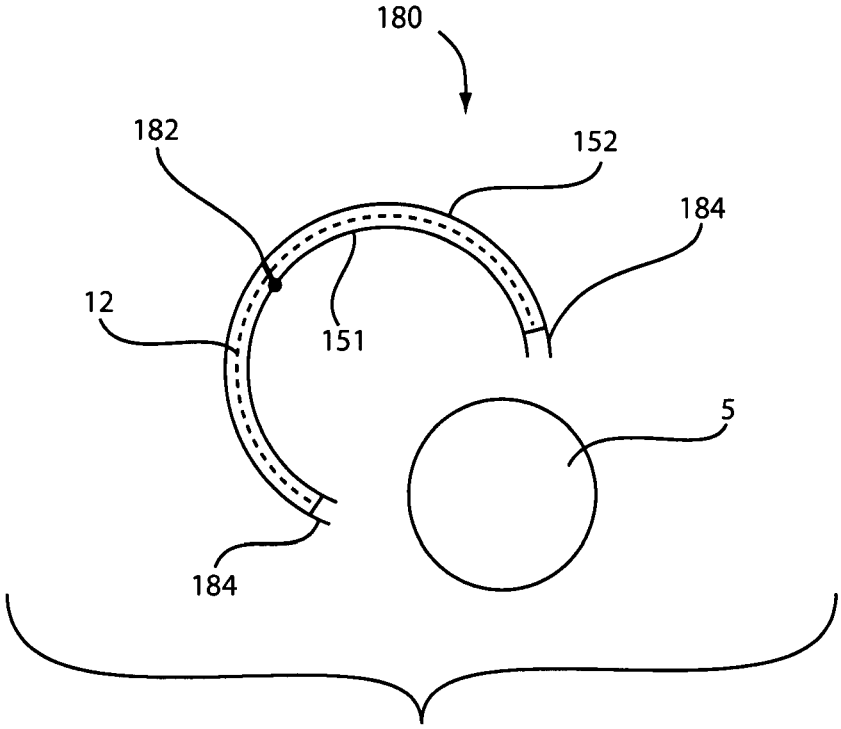
FIGS. 18 and 19 show the piling anti-lift system according to another embodiment of the invention.
Figure 19:
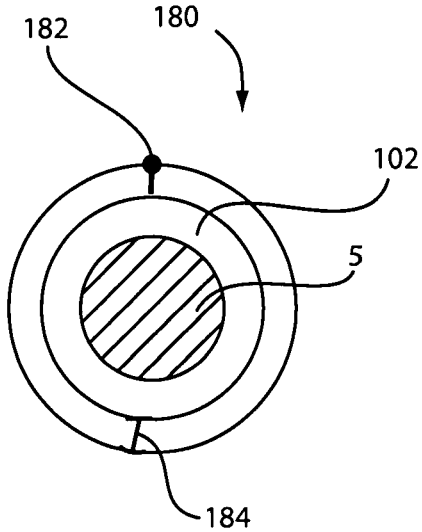

FIGS. 18 and 19 show a variation of the double tubular embodiment of FIGS. 15-17, where tubular members 151 and 152 are hinged together 182 to allow the wrapping of the piling anti-lift device 180 around a piling. This is particularly advantageous when the piling is connected to dock or other structure. The piling anti-lift system 180 includes a hinge 182 or other flexible point, and water proof latches or closures 184. Thus, when the system 180 is wrapped around a piling 5, the latches 184 engage each other and secure the system 180 around the piling. As explained above, the positioning of system 180 around the piling 5 such that an annular area 102 between the piling 5 and the system 180 exists, allows the system to maintain the piling's independence from the freezing surrounding water 100, and thereby prevents the piling from being subject to the extraordinary heaving and lifting forces generated by rising frozen tide waters.

While there have been shown, described and pointed out fundamental novel features of the invention as applied to preferred embodiments thereof, it will be understood that various omissions, substitutions and changes in the form and details of the methods described and devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed, described or suggested form or embodiment as a general matter of design choice. It is the intention, therefore, to be limited only as indicated by the scope of the claims appended hereto.

What is claimed is:

1. A system for preventing a water piling from uplifting, said system comprising:

a heat trace cable;

a support device adapted to receive and secure the heat trace cable in a substantially concentric configuration around the piling, said support device having a diameter larger than the piling so as to maintain an annular space of water between the support device and the piling, said support device comprising a flat sheet of material on which the heat trace cable is secured, and a waterproof covering for containing and sealing the flat sheet of material with said heat trace cable secured there on, from surrounding water, said flat sheet being wrapped around the piling in the concentric configuration; and electric connection means connected to said heat trace cable for providing power to said heat trace cable.

2. The piling anti-lift system according to claim 1, wherein said support device comprises a flat pipe having an elongate cavity and end seals for providing a water and air tight seal, said heat trace cable being disposed in said elongate cavity and being connected to said electric connection means through said flat pipe or said end seals.

3. The piling anti-lift system according to claim 2, wherein said end seals further comprise connection means for connecting the ends of said flat pipe together in said concentric configuration.

4. The piling anti-lift system according to claim 1, wherein said support device comprises at least two clips having a plurality of cable receiving portions for receiving and securing said heat trace cable.

5. The piling anti-lift system according to claim 1, wherein said support device comprises: a tubular member for receiving said heat trace cable; and a shrink wrapped layer that completely encloses said tubular member with said heat trace cable in a water and air tight manner.

6. The piling anti-lift system according to claim 5, wherein said shrink wrapped layer is one selected from a group consisting of plastic, rubber, and waterproof fabric.

7. The piling anti-list system according to claim 1, wherein said support device comprises:

a first tubular member for receiving said heat trace cable;

a second tubular member for receiving said first tubular member such that an air chamber is formed between said first and second tubular members; and end caps for enclosing the open ends between said first and second tubular members in a water and air tight manner.

8. The piling anti-lift system according to claim 1, wherein said support device comprises: a first longitudinally split tubular member for receiving said heat trace cable;

a second longitudinally split tubular member for receiving said first tubular member;

at least one latching device coupled to the longitudinal split of both said first and second tubular members, said at least one latching device enabling and first and second tubular members to be secured around the piling.

9. The piling anti-lift system according to claim 8, further comprising end caps positioned on said first and second tubular members and adapted to maintain a water tight connection while creating an air chamber between said tubular members.

10. The system according to claim 1, wherein said flat sheet further comprises connection means for connecting ends of said flat sheet together in said concentric configuration.

* * * * *